United States Patent [19]

Baxter et al.

[11] Patent Number: 5,014,624

[45] Date of Patent: May 14, 1991

[54] DISCARDING SABOTS

[75] Inventors: James E. Baxter, Cheshire; Robert D. Poole, Stoke-on-Trent, both of England

[73] Assignee: Royal Ordnance plc, London, England

[21] Appl. No.: 300,188

[22] Filed: Jan. 23, 1989

Related U.S. Application Data

[63] Continuation of Ser. No. 135,249, Dec. 21, 1987, abandoned.

[30] Foreign Application Priority Data

Dec. 24, 1986 [GB] United Kingdom ..... 8630848

[51] Int. Cl.[5] ..... F42B 10/34; F42B 14/06

[52] U.S. Cl. ..... 102/503; 102/520; 102/523

[58] Field of Search ..... 102/503, 513, 520–523

[56] References Cited

U.S. PATENT DOCUMENTS

| | | | |
|---|---|---|---|
| 3,164,092 | 1/1965 | Reed et al. | 102/522 |
| 3,446,147 | 5/1969 | Engel et al. | 102/523 |
| 3,771,458 | 11/1973 | Schweimler et al. | 102/523 |
| 3,951,071 | 4/1976 | Germershausen | 102/523 |
| 4,000,698 | 1/1977 | Corney | 102/522 |
| 4,249,466 | 2/1981 | Rossmann et al. | 102/93 |
| 4,301,736 | 11/1981 | Flatau et al. | 102/503 |
| 4,476,785 | 10/1984 | Hoffman et al. | 102/522 |
| 4,735,148 | 4/1988 | Holtzman et al. | 102/522 |

*Primary Examiner*—Harold J. Tudor

*Attorney, Agent, or Firm*—Stevens, Davis, Miller & Mosher

[57] ABSTRACT

A sabot for use with a spin stabilized projectile comprises a closed front end portion having lines or strips of weakness running along sides of the sabot which meet at a front end surface of the sabot, thereby providing a continuously extending line or region of weakness across the front end surface.

Preferably, the sabot front end portion has at least three, desirably four or more, lines or strips of weakness running along the length of the front end portion. These lines or strips may meet at an intersection of lines or strips at the front end surface, but they preferably meet at a front end membrane region.

Discarding sabots according to the present invention are especially suitable for use with tubular projectiles. These projectiles may for example be used in training ammunition rounds which are suitable for firing from the UK 30 mm RARDEN (UK Registered Trade Mark) Gun.

10 Claims, 1 Drawing Sheet

DISCARDING SABOTS

This application is a continuation of application Ser. No. 135,249, filed Dec. 21, 1987.

The present invention relates to discarding sabots for projectiles.

It is well known in the design of projectiles fired from a gun for the projectile to be provided as sub-calibre component which is used in conjunction with a full calibre sabot. The sabot, which imparts the propellant driving forces to the projectile on which it is fitted, is designed to break and discard soon after exit from the muzzle of the gun, leaving the projectile to travel towards its target.

Sabots used in conjunction with spin stabilised projectiles are conventionally made of a lightweight material having a reasonably high strength Such sabots normally include lines of weakness comprising break grooves running along the sabot length which assist breaking and discarding of the sabot after muzzle exit. In order to facilitate manufacture of the sabot with break grooves, the front end of the sabot normally comprises an open end or a solid portion which may be part of a nose cap forming a component of the sabot.

We have found that the performance of such conventional sabots is not ideal as described below.

We have now produced according to the present invention, a sabot construction which is unexpectedly superior to the conventional sabot constructions because it gives improved sabot performance in certain applications without significantly increased difficulty of manufacture.

According to the present invention a sabot for use with a spin stabilised projectile comprises a closed front end portion having lines or strips of weakness running along sides of the sabot which meet at a front end surface of the sabot, thereby providing a continuously extending line or region of weakness across the front end surface.

Preferably, the sabot front end portion has at least three, desirably four or more, lines or strips of weakness running along the length of the front end portion. These lines or strips may meet at an intersection of lines or strips at the front end surface, but they preferably meet at a front end membrane region.

Desirably, the thickness of material of the sabot front end portion along the lines or strips of weakness, including any membrane region where they meet, is in the range 0.05 to 0.5 t, e.g. between 0.1 t and 0.4 t, where t is the average thickness of the material in the remainder of the front end portion, i.e. the average thickness of the main part of the front end. For example, for a sabot of outer diameter of 25 mm to 30 mm, the average thickness t may be in the range 2 mm to 8 mm and the thickness of the lines or strips of weakness may be in the range 0.5 mm to 1.5 mm.

The lines or strips of weakness may be formed by grooves provided in the inner or outer surface of the sabot or both. For example, where break grooves are formed in the outer surface of the sabot the lines or strips of weakness comprise the material remaining at the inner end of the groove; The inner surface of the sabot may be continuous in the regions where the grooves are formed in the outer surface. As in the prior art, the break grooves may comprise at least at their inner end, as seen in transverse cross-section, a groove which is approximately V-shaped.

The sabot may have an overall shape comprising substantially a right circular cylindrical tube which includes a closed tapered nose portion at its front. The nose portion may form a separate component of the sabot or it may be an integral part thereof.

Preferably, the nose portion may comprise any suitable shape, e.g. an ogive or a portion having a frustro-conical inner or outer surface or a portion having an inner or outer surface or both which has a plurality of frustro-conical portions of different cone angle. The thickness of the side wall of the nose portion in regions other than the lines or strips of weakness may vary along its length. Where the nose portion is a separate sabot component, this side wall thickness may be reduced to substantially the same thickness as that of the lines or strips of weakness at the rear end of the nose portion.

Preferably, the nose portion has a front end having an outer diameter less than one fifth of the outer diameter of the sabot side wall in the region of its cylindrical tubular body. Preferably, the front end comprises a border comprising an annulus or other suitable shape having radially extending grooves therein and having in its non-grooved parts an average thickness t substantially the same as the thickness of the side wall of the sabot in the main part of its tubular body region and an inner membrane having a thickness of from 0.05 t to 0.5 t, e.g. 0.1 t to 0.4 t, formed by providing a recess in the front end in the region bounded by the border.

The sabot according to the present invention may be made of any of the materials conventionally used for production of discarding sabots and may be made by manufacturing methods which are known per se. For example, the sabot may be made of a lightweight polymeric material, e.g. a thermoplastic such as nylon, polycarbonate, polyester, phenolics or polyurethane or a thermosetting or cold setting polymer such as polyurethane. The polymeric material may be reinforced, e.g. with fibres such as glass, carbon, aramid, nylon, polyolefin or other known reinforcing fibres. Alternatively, the sabot may be made of a high strength lightweight alloy such as an aluminium or magnesium alloy.

Where the sabot according to the present invention is made from a polymeric material it may be made by injection moulding, compression moulding or any other suitable known process. The lines or strips of weakness and the optional membrane may be formed in such a moulding process and/or may be formed by subsequent machining.

Where the sabot according to the present invention is made from a metallic material it may be cast or spun or extruded or machined. The lines or strips or weakness and the optional membrane may be formed during this process and/or by subsequent machining.

Discarding sabots according to the present invention are especially suitable for use with tubular projectiles. These projectiles may for example be used in training ammunition rounds which are suitable for firing from the 30 mm RARDEN (UK Registered Trade Mark) Gun manufactured by the present Applicant Company. Where a tubular projectile is used in conjunction with a sabot according to the present invention the tubular projectile preferably has in cross-section in a plane containing the projectile axis a front portion having an inner surface conically converging in a direction facing toward the rear end of the projectile, an intermediate portion having an inner surface of substantially constant diameter and a rear portion having an inner surface conically diverging in a direction facing toward the rear end of the projectile. Such projectiles may for example be of the form invented by Abraham Flatau and Joseph Huerta as described in U.S. Pat. No. 1,571,010 assigned to the present Applicant Company, Royal Ordnance plc.

Tubular projectiles used in conjunction with sabots according to the present invention may incorporate a tracer element as described in copending UK Patent Application No. 8,628,514 by the present Applicant Company.

We have found that where discarding sabots are used with tubular projectiles, it is highly desirable when the sabot breaks, to avoid the formation of sabot pieces which might become lodged in the open front end of the tubular projectile, thereby affecting the aerodynamic properties of the projectile. We have demonstrated in firing trials involving high speed photography, that prior art sabots which contain a solid front portion as mentioned above can break in such a manner that pieces are formed which might lodge in a tubular projectile. This problem may be overcome by the use of known sabots having an open ended front portion, but such open-ended sabots suffer from the disadvantage of lacking an environmental barrier, e.g. to protect against the ingress of rainwater. The sabots according to the present invention have been shown by firing trials surprisingly to break cleanly into substantially equal sized petals which discard laterally of the projectile. The closed front end of such sabots provides a suitable environmental barrier.

Embodiments of the present invention will now be described by way of example with reference to the accompanying drawings, in which.

Figure 1:
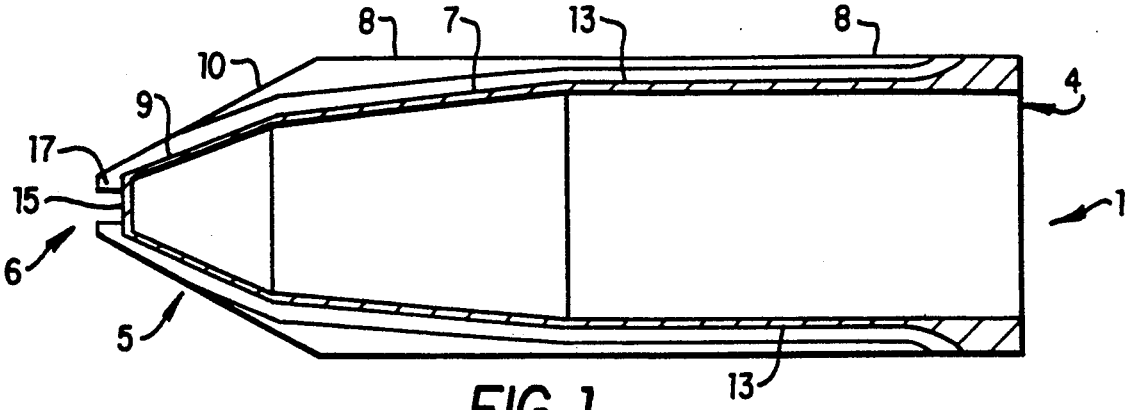
FIG. 1 is a longitudinal cross-sectional view of a sabot embodying the present invention.
Figure 2:
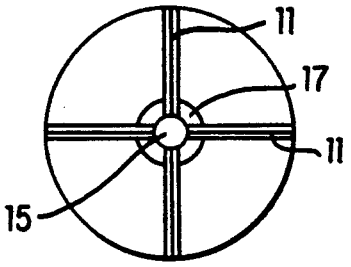
FIG. 2 is an end view as seen at the front end of the sabot shown in FIG. 1.

In FIGS. 1 and 2 a sabot 1 comprises a circular cylindrical tubular body 3 having an open rear end 4 and a front nose portion 5 comprising a closed front end 6. The nose portion 5 has an inner surface which comprises a frustro-conical region 7 and a frustro-conical region 9 of increased cone angle. The outer surface comprises a cylindrical region 8 and a frustro-conical region 10, the nose portions has four equally spaced break grooves 11 running along its length. The grooves 11 are parallel-sided grooves which are seen in FIG. 2 to terminate in cross-section with an approximate V-shape leaving a strip 13 (FIG. 1) at the end of the V-shape i.e. formed adjacent to the inner surface of the sabot 1. The front end 6 of the sabot 1 comprises a membrane 15 of thickness similar to that of the strips 13 at which the strips 13 meet. An annular border 17 of thicker material, through which the grooves 11 pass, surrounds the membrane 15 at the front end 6 as a continuation of the nose portion 5. The grooves 11 become shallow and eventually run out adjacent to the rear end 4.

In operation, the sabot 1 after exit from a gun muzzle (not shown) breaks about its rear end which acts as a hinge, into four substantially equal petals along the strips 13 which discard laterally relative to the axis of the sabot 1.

Figure 3:
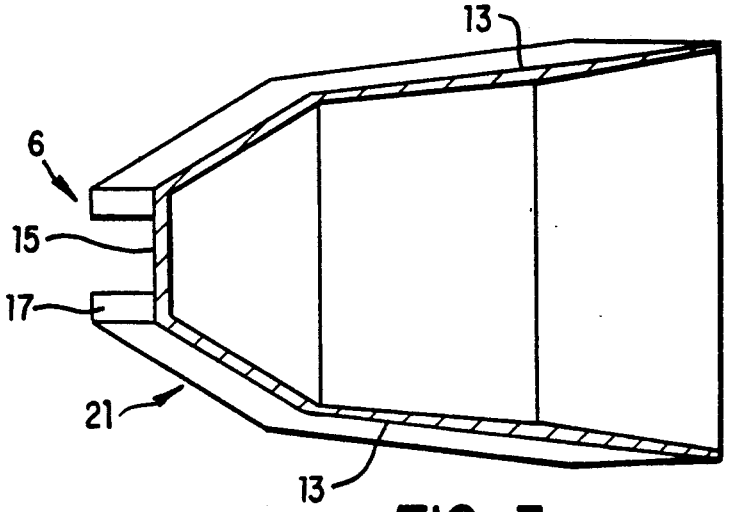
FIG. 3 is a longitudinal cross-sectional view of a component of an alternative sabot embodying the present invention.

FIG. 3 shows a nose cap 2 of an alternative sabot. In this case the sabot comprises two parts, a substantially cylindrical body (not shown) and a nose cap portion as shown in FIG. 3. Parts similar to those of the sabot 1 shown in FIGS. 1 and 2 are given like reference numerals. In the case of FIG. 3, the break grooves 13 are V-shaped but do not contain a parallel-sided section and the thickness of the nose cap 21 tapers toward its rear end. The overall shape of the outer surface is similar to that of the inner surface of the nose cap 21. Otherwise, the nose cap 21 has a construction and operation similar to that of the front portion of the sabot 1 of FIG. 1.

Figure 4:
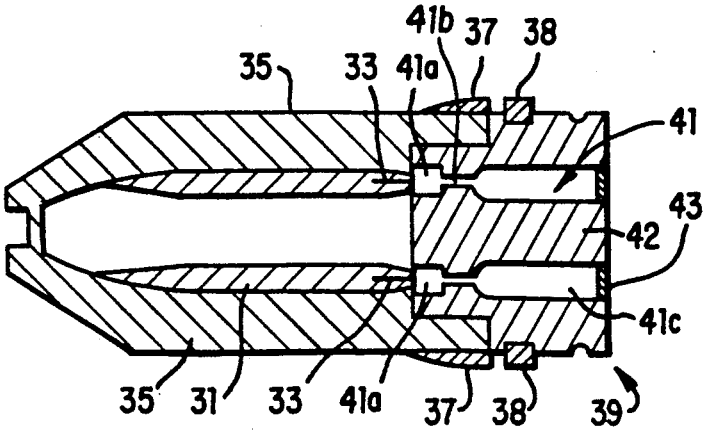
FIG. 4 is a longitudinal cross-sectional view of a discard sabot-projectile assembly in accordance with the invention comprising a tubular projectile and a sabot similar to that of FIGS. 1 and 2.

FIG. 4 illustrates a construction for launching a tubular projectile in conjunction with a sabot embodying the present invention and for igniting a tracer composition contained in the projectile rear end wall in the manner described and claimed in UK Patent Application No. 8628514. The projectile is indicated by reference numeral 31. The tracer composition of the projectile 31 is indicated by reference numeral 33. A sabot 35 which is of a form similar to that described above with reference to FIG. 1, is fitted over the projectile 31. A driving band 37 is attached to the outer surface of the sabot 35. A base pusher 39 carrying an obturator 38 is located behind the rear surface of the projectile 31 and rear surfaces the sabot 35 which include a circular recess into which a corresponding portion 42 of the base pusher 39 fits. The pusher 39 has an annular channel 41 extending therethrough in a direction parallel to the axes of the pusher 39 and projectile 31. The channel 41 has three regions, namely an annular recess **41*a* facing the tracer composition 33, a narrow portion 41*b* and a wider portion 41*c* behind the narrow portion 41*b*. The wider portion 41*c* houses an annular septum 43**.

In operation, the base pusher 39 is contained inside a gun in a conventional launch cartridge (not shown) in front of a known gun propellant (not shown). When the gun is fired the propellant is ignited causing a rapid expansion of gas which is obturated by the obturator 38. The pressure built up causes the projectile 31 and sabot 35 to be driven by the pusher 39 in a forward direction out of the gun. The driving band 37 engages the rifling of the gun (not shown) to impart spin to the projectile to maintain stability of the projectile in flight.

When the pressure of the hot propellant gas produced by the initiation of the main propellant charge reaches a pre-determined limit the septum 43 bursts allowing the gas to enter the channel 41 and reach the tracer composition 33 which it thereby ignites.

The narrow portion **41*b* allows this to be achieved without a build-up of undesirable high gas pressure behind the projectile 31. It is desirable to prevent such a build-up in order to prevent gas leakage on separation of the projectile 31 from the pusher 39** before acceleration starts.

On leaving the muzzle of the gun the sabot 35 is rapidly discarded in the manner described above with reference to FIGS. 1 and 2 allowing the projectile 31 to proceed toward the target. The tracer composition allows the trajectory of the projectile to be tracked in flight.

We claim:

1. A spin stabilised projectile assembly comprising a tubular projectile and a discarding sabot mechanically engaged on and embracing the tubular projectile to enclose the front end of the tubular projectile, said sabot comprising a closed front end portion having elongate lateral zones of weakness which meet at a front end surface of the sabot, thereby providing a continuous zone of weakness extending across the front end surface and joining together said elongate lateral zones to provide distinct fracture lines along which the sabot will break into substantially equal-sized petals.

2. An assembly as in claim 1 wherein the sabot front end portion has at least three said elongate lateral zones of weakness running along the length of the front end portion.

3. An assembly as in claim 1 wherein the elongate lateral zones of weakness meet at a front end membrane region of the sabot.

4. An assembly as in claim 1 wherein the thickness of material of the sabot front end portion along the elongate lateral zones of weakness is in the range, 0.05 to 0.5 t, where t is the average thickness of the material in the remainder of the front end portion.

5. An assembly as in claim 1 wherein the elongate lateral zones of weakness are formed by grooves provided in a surface of the sabot, each of the grooves comprising at least at its inner end, as seen in transverse cross-section, a groove which is approximately V-shaped.

6. An assembly as in claim 1 wherein the sabot comprises a nose portion which constitutes a separate component of the sabot.

7. An assembly as in claim 6 wherein the nose portion has inner and outer surfaces each of which comprises at least one frusto-conical portion.

8. An assembly as in claim 1 wherein the tubular projectile has in cross-section in a plane containing the longitudinal axis of the projectile a front portion having an inner surface conically converging in a direction facing toward the rear end of the projectile, an intermediate portion having an inner surface of substantially constant diameter and a rear portion having an inner surface conically diverging in a direction facing toward the rear end of the projectile.

9. An assembly as in claim 8 wherein the tubular projectile incorporates a tracer element embedded in a groove in the rear end wall of the tubular projectile.

10. A discard sabot-projectile assembly, comprising:

a hollow tubular projectile having a substantially tubular shape; and a sabot fitted to said projectile; and wherein said tubular projectile has in a cross-section in a plane containing a longitudinal axis of the projectile a front portion having an inner surface conically converging toward the rear of the projectile, an intermediate portion having an inner surface of substantially constant diameter, and a rear portion having an inner surface conically diverging toward the rear of the projectile; and wherein said sabot comprises a front end portion having at least three elongate longitudinal grooves, said grooves being V-shaped in transverse cross-section at least at their bases, and said sabot further comprises a membrane which closes at its front end, said grooves meeting at said membrane thereby to form a continuous zone of weakness comprising said grooves and said membrane, said continuous zone of weakness thus extending laterally and over the front end of the sabot, and the thickness of the material forming the sabot throughout the continuous zone of weakness being in the range 0.05 t–1.5 t where t is the average thickness of the material in the remainder of the front end portion of the sabot.

* * * * *